US011627842B2

(12) United States Patent
Bethmann et al.

(10) Patent No.: US 11,627,842 B2
(45) Date of Patent: Apr. 18, 2023

(54) BATHING TUB AND OCCUPANT SUPPORT THEREFOR

(71) Applicant: Thorley Industries, LLC, Pittsburgh, PA (US)

(72) Inventors: Jamie Bethmann, Pittsburgh, PA (US); Richard Juchniewicz, Pittsburgh, PA (US); Michael Laude, Upton, MA (US); Juan Santocono, Pittsburgh, PA (US); Gustavo Fontana, Framingham, MA (US); Phil Carpenter, Pittsburgh, PA (US)

(73) Assignee: Thorley Industries, LLC, Pittsburgh, PA (US)

( * ) Notice: Subject to any disclaimer, the term of this patent is extended or adjusted under 35 U.S.C. 154(b) by 139 days.

(21) Appl. No.: 17/331,470

(22) Filed: May 26, 2021

(65) Prior Publication Data

US 2021/0369056 A1 Dec. 2, 2021

Related U.S. Application Data

(60) Provisional application No. 63/030,470, filed on May 27, 2020.

(51) Int. Cl.
*A47K 3/024* (2006.01)
*A47K 3/12* (2006.01)

(52) U.S. Cl.
CPC ..... *A47K 3/024* (2013.01); *A47K 3/122* (2013.01); *A47K 3/127* (2013.01)

(58) Field of Classification Search
CPC ..... A47K 3/024; A47K 3/127; A47K 3/122
USPC ..... 4/572.1
See application file for complete search history.

(56) References Cited

U.S. PATENT DOCUMENTS 1,454,112 A * 5/1923 Graves ..... A47K 3/127 4/571.1
1,512,068 A 10/1924 Thornburg
1,758,071 A * 5/1930 Bleustein ..... A47K 3/024 4/572.1
1,817,596 A * 8/1931 Whalen ..... A47K 3/024 4/585
2,389,362 A * 11/1945 Newman ..... A47K 3/127 D23/278
2,460,308 A * 2/1949 Pribil ..... A47D 15/008 5/655
2,487,228 A * 11/1949 Feichtmeir ..... A47K 3/074 D23/278

(Continued)

*Primary Examiner* — Benjamin R Shaw
(74) *Attorney, Agent, or Firm* — Perman & Green, LLP

(57) ABSTRACT

A baby bathing system including a bathing tub, having a reservoir and a bath basin connected to the reservoir by a weir discharging bath water from the reservoir into the bath basin. A baby bath support insert is received within the bath basin downstream of the reservoir, the baby bath support insert having a flexible seat and a base projection projecting from the flexible seat towards the bath basin. The base projection is conformally seated against an interior surface of the bath basin and supports the flexible seat raised from the interior surface of the bath basin with the baby bath support insert received in the bath basin. The base projection includes at least one aperture extending through the base projection and disposed so that bath water from under the flexible seat communicates through the base projection with outer sides of the bath basin.

30 Claims, 9 Drawing Sheets

(56) References Cited

U.S. PATENT DOCUMENTS 2,507,848 A * 5/1950 Bashaw ..... A47K 3/127 D23/278
2,535,259 A * 12/1950 Boyington ..... A47K 3/024 4/572.1
2,563,076 A * 8/1951 Schreckengost ..... A47K 3/127 D23/278
2,836,833 A * 6/1958 Carlson ..... A47K 3/127 5/655
2,985,889 A 7/1958 Fain et al.
4,295,683 A * 10/1981 Dubbink ..... A47K 3/122 4/575.1
4,881,281 A * 11/1989 Lavoine ..... A47K 3/034 4/659
4,974,267 A 12/1990 Sheu
5,181,284 A * 1/1993 Raphael ..... A47K 3/024 4/573.1
5,361,430 A * 11/1994 Wise ..... A47K 3/024 4/573.1
5,491,850 A * 2/1996 Kiester ..... A47K 3/127 4/572.1
5,588,159 A * 12/1996 Poulson ..... A47K 3/024 4/575.1
5,722,100 A * 3/1998 Jozwiak ..... A47D 15/008 5/655
5,926,866 A * 7/1999 Chao ..... A47K 3/024 4/575.1
6,018,826 A * 2/2000 Yang ..... A47K 3/064 4/575.1
6,112,343 A * 9/2000 Dixon ..... A47K 3/024 4/586
6,243,890 B1 * 6/2001 Yang ..... A47K 3/024 4/573.1
6,578,209 B2 6/2003 Lopes et al.
6,785,917 B1 * 9/2004 Bryant ..... A47K 3/024 4/659
7,065,805 B1 * 6/2006 Sundberg ..... A47K 3/127 5/103
7,856,678 B2 * 12/2010 Thorne ..... A47K 3/024 4/572.1
7,886,375 B2 * 2/2011 Thorne ..... A47K 3/024 4/572.1
9,179,805 B1 * 11/2015 Spratt-Anderson .... A47K 3/127
9,622,622 B2 * 4/2017 Sundberg ..... A47K 3/06
10,080,464 B2 * 9/2018 Daley ..... A47K 3/127
10,433,679 B2 * 10/2019 Kwak ..... F16B 2/22
11,369,232 B2 * 6/2022 Fabre ..... A47D 15/006
2003/0070219 A1 * 4/2003 Lopes ..... A47K 3/024 4/572.1
2006/0179568 A1 8/2006 Campbell
2014/0345042 A1 * 11/2014 Morand ..... A47K 3/127 4/572.1
2018/0242793 A1 8/2018 Kwak et al.

* cited by examiner

BATHING TUB AND OCCUPANT SUPPORT THEREFOR

CROSS REFERENCE TO RELATED APPLICATIONS

This application is a non-provisional of and claims the benefit of U.S. provisional patent application No. 63/030,470 filed on May 27, 2020, the disclosure of which is incorporated herein by reference in its entirety.

BACKGROUND

1. Field

The exemplary embodiments generally relate to bathing tubs, and more particularly, to infant and toddler bathing tubs.

2. Brief Description of Related Developments

Plastic infant and toddler bathing tubs are well known. Very young infants are unable to sit unsupported, and so are typically bathed in a reclined position. Inexpensive molded plastic tubs with integral inclined infant and toddler supports are sold for this purpose. These tubs are typically configured to be set upon a horizontal surface, such as a kitchen countertop, for use, and some of these tubs can fit in standard kitchen single basin and/or double basin sinks. Within the meaning of this application the term "occupant" will collectively reference infants and toddlers. Many developments have been proposed to address baby bathing issues.

Generally, in some aspects, an occupant is supported within the infant and toddler bathing tub by a contoured inner surface of the infant and toddler bathing tub. In other aspects, the occupant is supported within the infant and toddler bathing tub by a removable support that is inserted into an interior of an infant and toddler bathing tub. Generally, in one aspect, the removable supports are constructed of a contoured rigid material (either a rigid plastic or coated metal), that does not bend or flex. These rigid removable supports rest on an interior surface of the infant and toddler bathing tub and support the occupant thereon. In other aspects, the removable supports are constructed of a mesh cloth material where opposite ends of the mesh material are connected to the infant and toddler bathing tub so as to form a suspended support surface similar to a hammock. The removable inserts, whether constructed of a rigid material or a mesh cloth material, may allow for shifting or tilting forward of the occupant while bathing inside the infant and toddler bathing tub.

BRIEF DESCRIPTION OF THE DRAWINGS

The foregoing aspects and other features of the disclosed embodiment are explained in the following description, taken in connection with the accompanying drawings, wherein.

DETAILED DESCRIPTION

Figure 1:
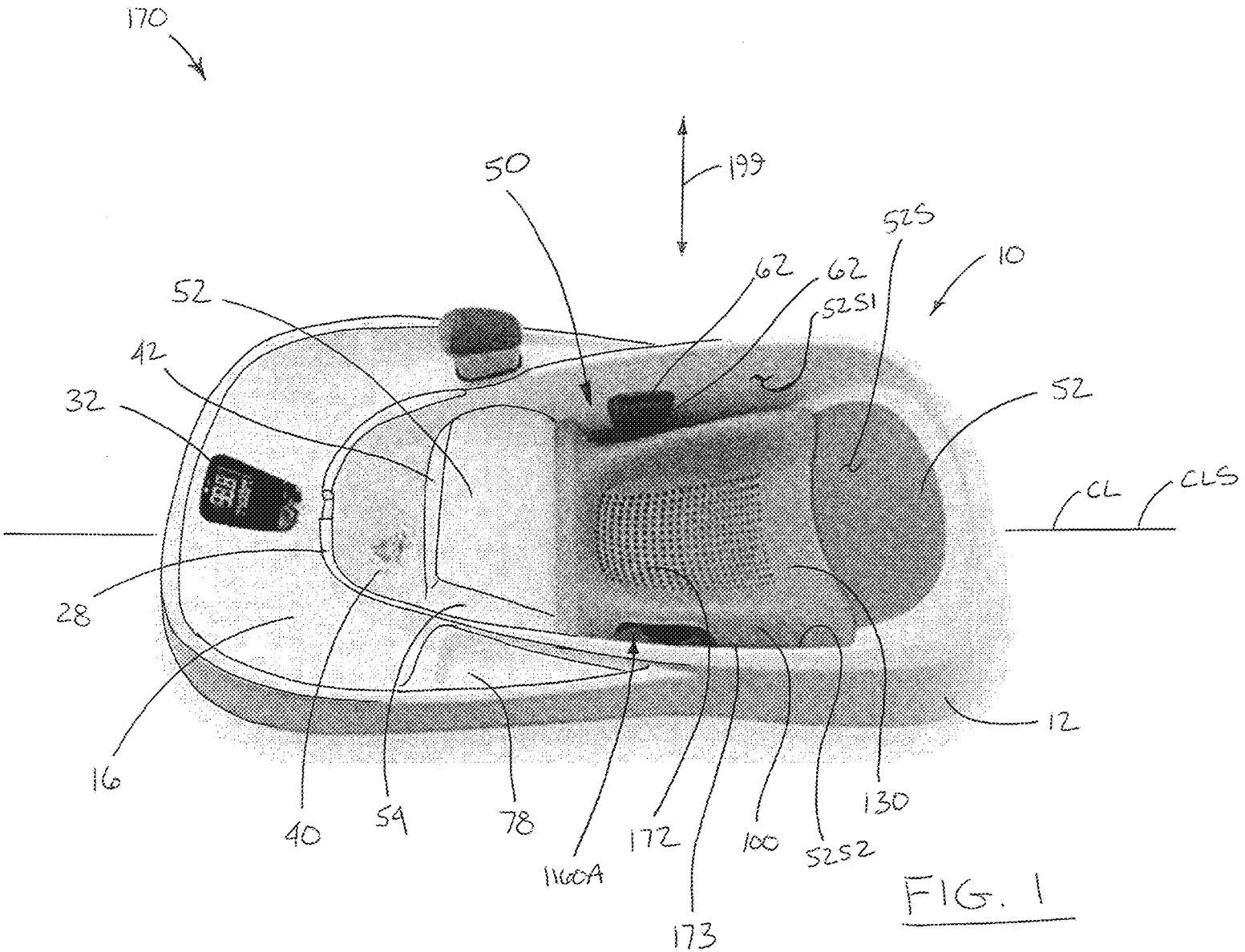
FIG. 1 is a top perspective view of an infant and toddler bathing tub in accordance with aspects of the present disclosure.
Figure 2:
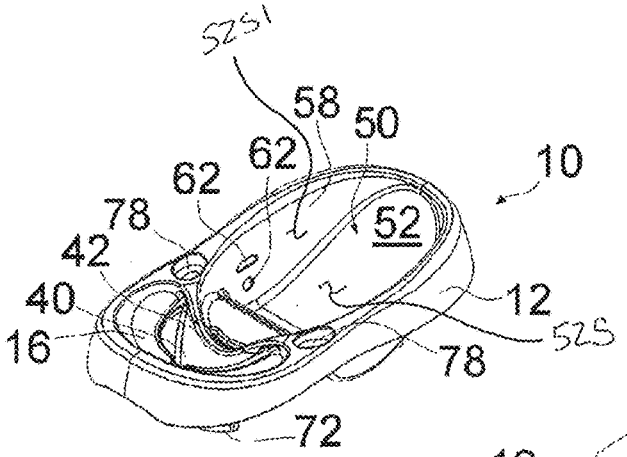
FIGS. 2 and 3 are opposite side top perspective views of the infant and toddler bathing tub of FIG. 1 in accordance with aspects of the present disclosure.
Figure 3:
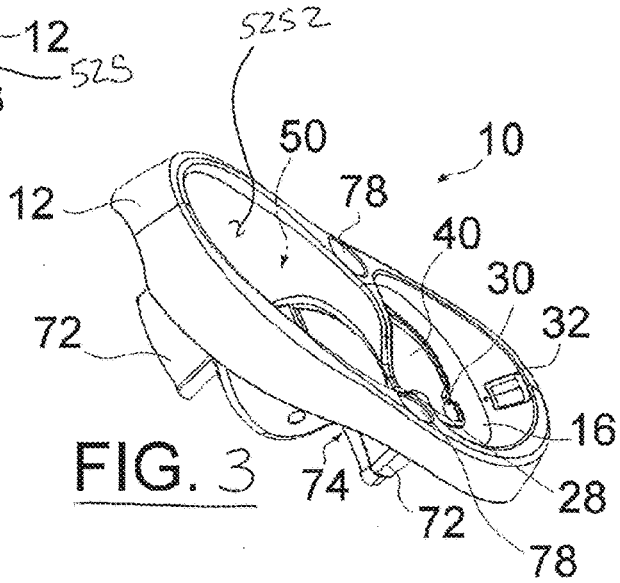

FIG. 1 illustrates an exemplary occupant bathing system 170 that includes an infant and toddler bathing tub 10 (referred to herein as a "bathing tub") and an occupant bath support insert 100 (also referred to herein as a removable occupant support) in accordance with aspects of the present disclosure. Although the aspects of the present disclosure will be described with reference to the drawings, it should be understood that the aspects of the present disclosure can be embodied in many forms. In addition, any suitable size, shape or type of elements or materials could be used.

Figure 4:
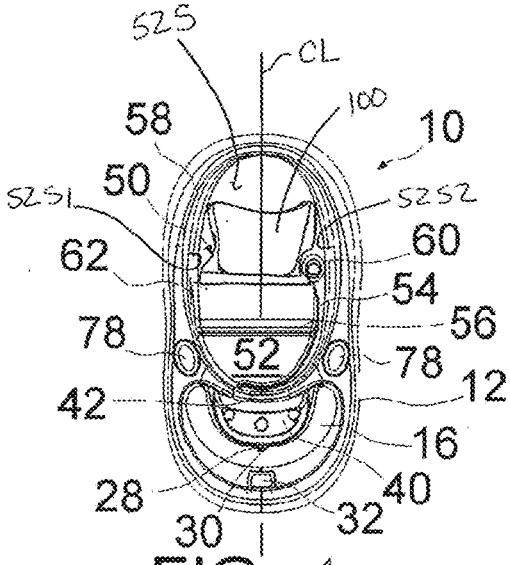
FIG. 4 is a top plan view of the infant and toddler bathing tub of FIG. 1 in accordance with aspects of the present disclosure.
Figure 5:
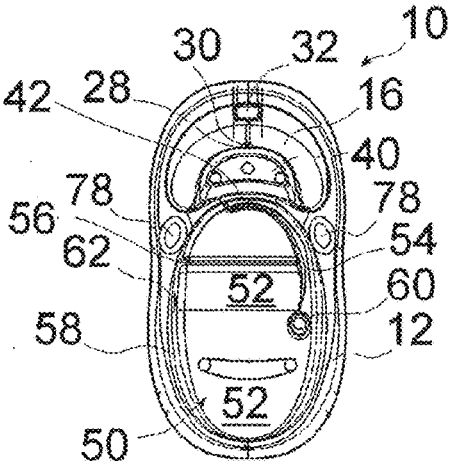
FIG. 5 is a bottom plan view of the infant and toddler bathing tub of FIG. 1 in accordance with aspects of the present disclosure.
Figure 6:
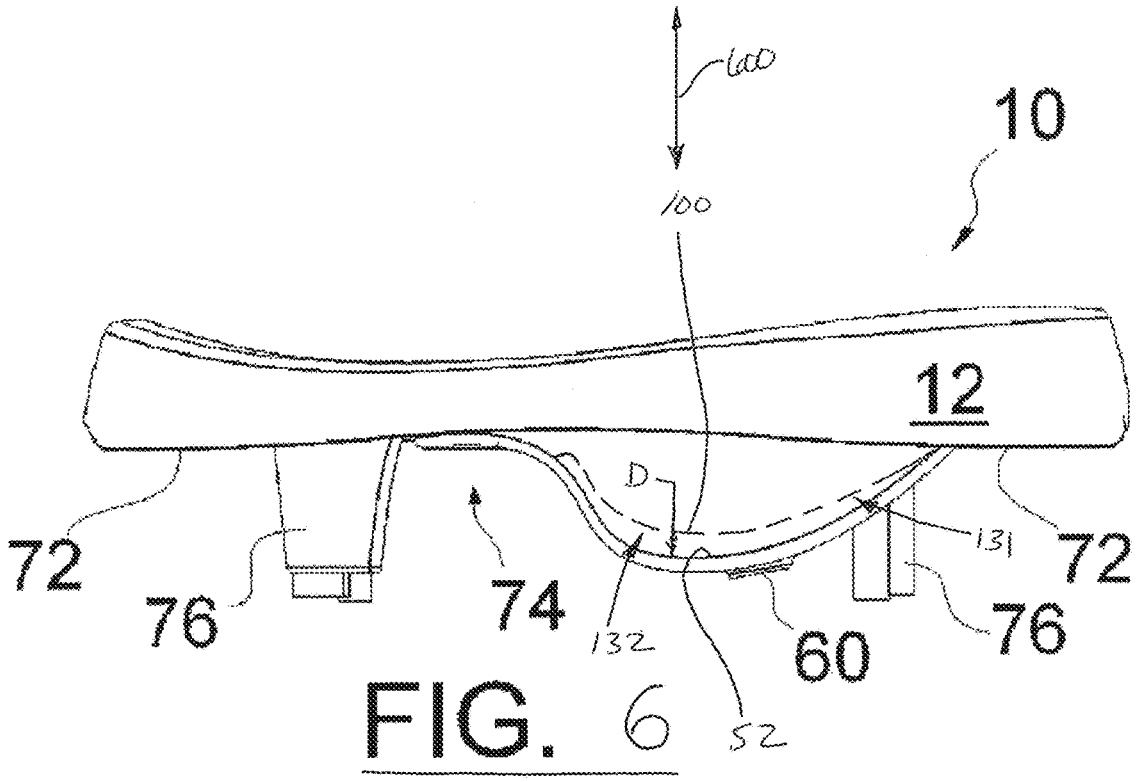
FIGS. 6 and 7 are opposite elevation side views of the infant and toddler bathing tub of FIG. 1 in accordance with aspects of the present disclosure.
Figure 7:
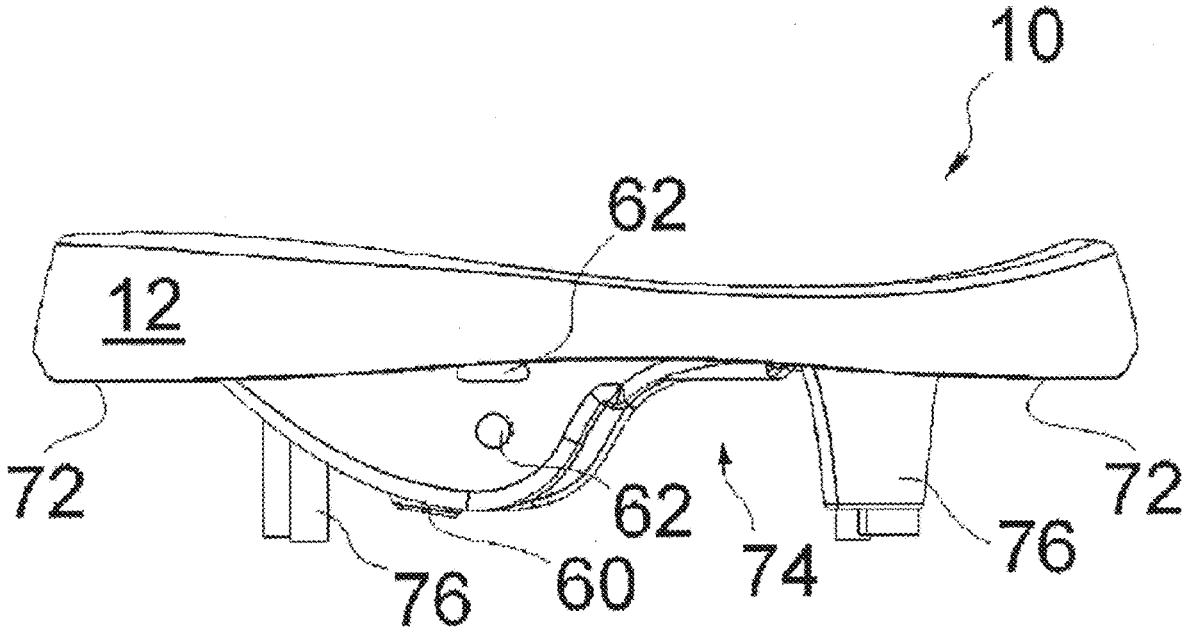
Figure 8:
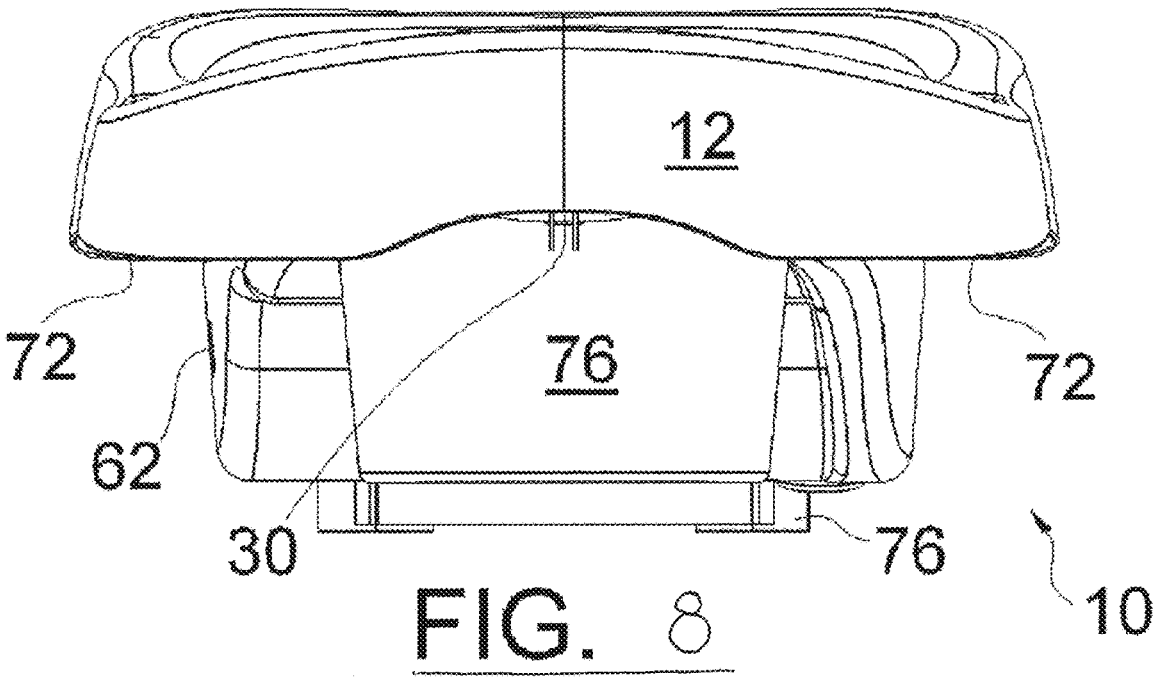
FIGS. 8 and 9 are opposite end elevation views of the infant and toddler bathing tub of FIG. 1 in accordance with aspects of the present disclosure.
Figure 9:
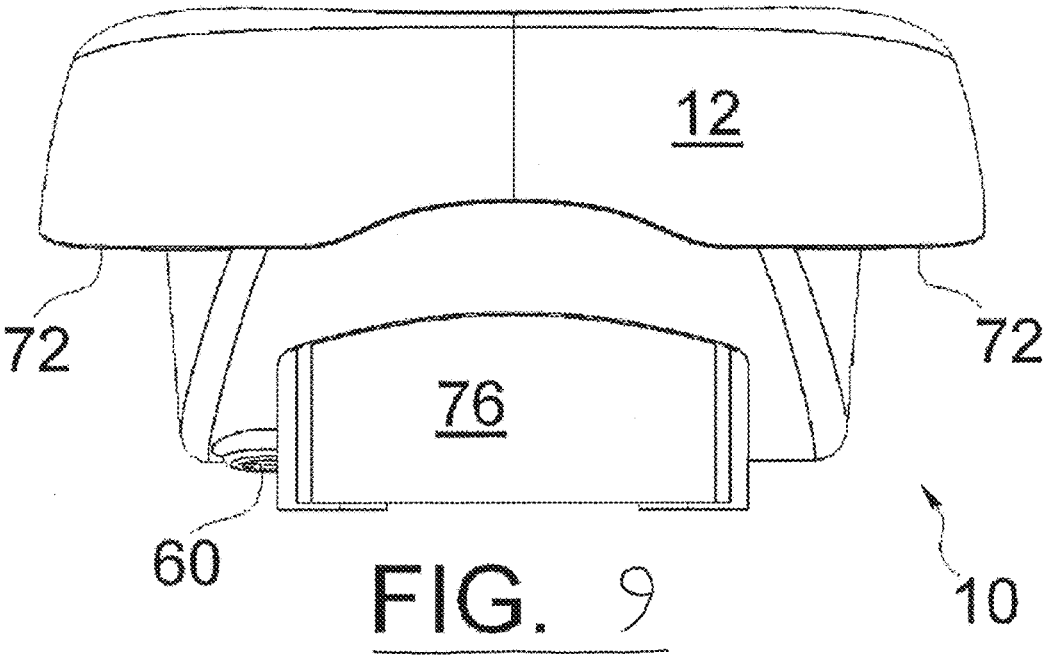
Figure 12:
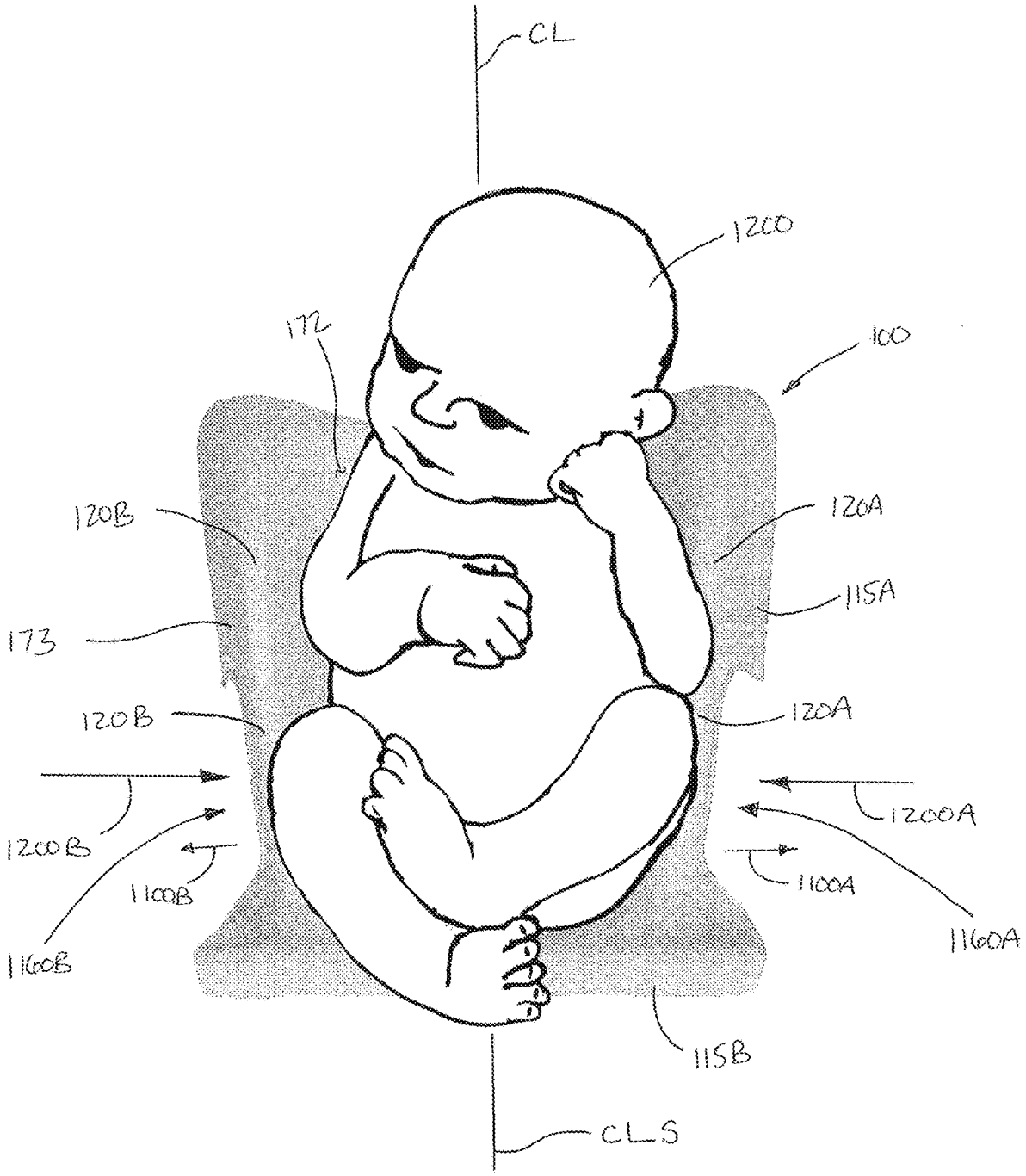
FIG. 12 is an exemplary illustration of an occupant sitting within the removable insert of the infant and toddler bathing tub of FIG. 1 in accordance with aspects of the present disclosure.

The aspects of the present disclosure described herein provide the occupant bathing system 170 which cradles and gently hugs an occupant 1200 (i.e., baby or toddler—see FIG. 12) while bathing inside the bathing tub 10 to substantially prevent shifting or tilting forward of the occupant 1200 within the bathing tub 10. For example, the removable occupant support 100 is configured to react to the presence of an occupant 1200 thereon so as to resiliently move and hold the occupant 1200 in a predetermined position within the bathing tub 10. The resilient movement of the removable occupant support 100 causes the removable occupant support 100 to engage or otherwise embrace the occupant's hips (as described in greater detail herein) so as to hold the occupant 1200 in the predetermined position substantially along a centerline CL (see FIG. 4) of the bathing tub 10.

Referring to FIGS. 1-9, the bathing tub 10 may be substantially similar to those described in U.S. Pat. No. 7,856,678 issued on Dec. 28, 2010 and U.S. Pat. No. 7,886,375 issued on Feb. 15, 2011, the disclosures of which are incorporated herein by reference in their entireties. For example, the bathing tub 10 includes a molded plastic tub body 12, although the bathing tub 10 may be formed in any suitable manner from any suitable material. The tub body 12 defines a shallow catch pan depression 16 extending to the lateral left hand and right hand sides of the bathing tub 10. The pan depression 16 is configured to receive the water flow of a conventional single or double basin sink, with the bathing tub facing either direction. The two elongated, curving depressions on either lateral side of the bathing tub 10 that form the pan depression 16 allow the bathing tub 10 to easily accommodate the vast majority of conventional sink spigot designs. In addition to receiving water from a sink spigot, the pan depression 16 can also easily receive water from a bathtub spigot, although receiving water from a bathtub spigot does not introduce significant design limitations as compared to sinks as there is generally greater room for bathing tub 10 adjustments within a conventional bathtub. The water received within the pan depression 16 will be directed to pan weir 28 where a temperature of the water is determined (using any suitable temperature sensor mechanism 30) and presented on any suitable display 32.

The pan weir 28 exits to a deeper reservoir 40 formed in the upper portion of the tub body 12. The reservoir 40 provides a thermal buffer for the bathing water between the source of bathing water and an occupant bathing portion or area (also referred to herein as a bath basin). The reservoir may be formed with a lower drain and associated drain plug (not shown) that would allow for draining of the reservoir 40 after use with the bathing tub 10 in a horizontal position. In other aspects, the reservoir may be formed, such as with an angled bottom surface, to expedite draining into the occupant bathing portion 50 after use of the bathing tub 10 by tilting (i.e. picking up) one end of the bathing tub 10.

The reservoir 40 has a reservoir weir 42 exiting the reservoir 40 into the occupant bathing portion 50, wherein occupant bathing portion 50 is configured to receive the bathing water from the source of bathing water through the reservoir 40 and the reservoir weir 42. The pooling of water within the reservoir 40 will provide a thermal buffer for the bathing water between the source of bathing water and the occupant bathing portion 50. Consequently, minor temperature fluctuations in the water temperature will be taken out of the water due to the pooling prior to the water entering the occupant bathing portion 50. Further, in case of unsafe water temperatures in the measured water temperature measured by temperature sensor mechanism 30, there is a buffer allowing the parent to remedy the dangerous condition or merely the undesired condition (e.g. shut off the water flow, adjust the water temperature to the desired amount), before the unsafe or undesirable condition of the water temperature reaches the occupant.

The occupant bathing portion 50 includes an integral contoured floor/occupant back rest 52 formed in the tub body 12. The removable occupant support 100, which will be described in greater detail herein, rests on at least a portion of the integral contoured floor/occupant back rest 52 to support smaller occupants (e.g., infants), where the removable occupant support 100 may be removed so that larger occupants (e.g., toddlers) are supported substantially directly on the integral contoured floor/occupant back rest 52. The occupant bathing portion 50 includes a single water flow channel 54 formed in the molded tub body 12 and extending from the reservoir weir 42 to one side of the occupant bathing portion 50. The single side water flow channel 54 provides a continuous clean water circulation within the occupant bathing portion 50 (as described in U.S. Pat. Nos. 7,856,678 and 7,886,375, previously incorporated by reference herein), although in other aspects, dual flow channels 54 could be formed on either side of the occupant bathing portion 50 to uniformly distribute the bathing water to within the occupant bathing portion 50. A bypass channel 56 and side walls 58 also are integrally formed in the tub body 12 and form the remainder of the occupant bathing portion 50. The channel 56 is provided to prevent the occupant from forming a dam in the occupant bathing portion 50 and having bathing water accumulate on one side of the bathing portion (and be drained from the opposite side).

A drain opening 60 or any number of suitable drain openings 60 is/are formed through the integral contoured floor/occupant back rest 52 of the tub body 12 to allow for complete drainage of the occupant bathing portion 50 with the bathing tub 10 in a horizontal orientation. A conventional removable plug (not shown) is provided to close the drain opening 60 for bathing operation. The occupant bathing portion further includes bathing height regulating holes 62 through the side wall 58 of the tub body 12. The bathing height regulating holes 62 are spaced from the integral contoured floor/occupant back rest 52 forming surface 52S and are configured to define the conventional bathing height of the bath in the occupant bathing portion 50, such as about two (2) inches to about eight (8) inches of bathing water. The bathing height regulating holes 62 are provided at varying heights defining distinct bathing water depths. A removable plug (not shown) engages and plugs the lower bathing height regulating hole(s) when the desired bathing depth is defined by the upper bathing height regulating hole 62.

Figure 13D:
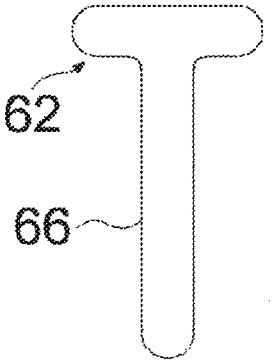
FIGS. 13A-13D are schematic figures of height regulation orifice configurations for the infant and toddler bathing tub of FIG. 1 in accordance with aspects of the present disclosure.
Figure 13C:
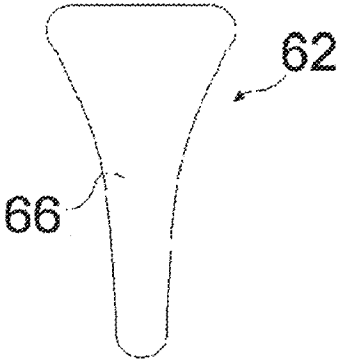
Figure 13B:
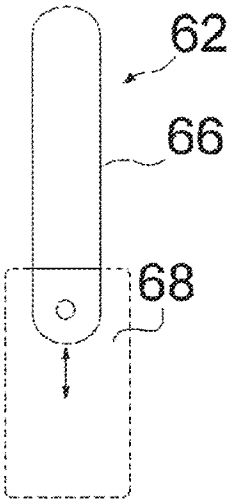
Figure 13A:
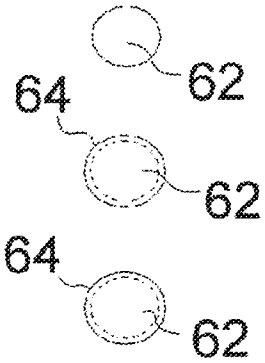

It is anticipated that the bathing height regulating holes 62 may take a variety of forms. FIG. 13A illustrates an arrangement, in accordance with one or more aspects of the present disclosure, in which a series of three bathing height regulating holes 62 are provided at varying heights defining distinct bathing water depths. Plugs 64 engage and plug those holes at the un-desired depths, although the topmost bathing height regulating hole 62 needs no removable plug, but may be configured to receive one to act as a plug holder when one of the lower holes is being utilized. FIG. 13B illustrates an arrangement, in accordance with one or more aspects of the present disclosure, in which the bathing height regulating holes are in the form of an elongated slot 66 with a height adjusting weir 68 that can variably define the bathing height. FIG. 13C illustrates an arrangement, in accordance with one or more aspects of the present disclosure, in which the bathing height regulating holes 62 are in the form of an elongated slot 66 with a widening configuration, whereby the flow of the water will define the bathing height and whereby the outflow "drastically" increases as the depth increases. It should be appreciated that with any hole configuration that is above the drain location, as the height of the bathing water raises from the beginning of a bathing height regulating hole 62 to the uppermost portion of the bathing height regulating hole 62, the effective area of the bathing height regulating hole 62 that is draining water is increasing. FIG. 13C illustrates an aspect that exaggerates this effect. FIG. 13D illustrates an arrangement, in accordance with one or more aspects of the present disclosure, in which the bathing height regulating holes 62 are in the form of an elongated T-shaped slot 66 in which the height of the T effectively defines a maximum bath height. It is noted that the above-described hole shapes are exemplary only and the holes may have any other suitable shape(s) for regulating at least a water level height within the bathing tub 10.

The bathing height regulating holes 62, in whatever particular form, provide for a continuous flow of clean water through the bath, increasing the hygiene offered by the bathing tub 10. The bathing height regulating holes 62 are above the integral contoured floor/occupant back rest 52 (in the configuration shown) providing a certain depth to the bath for the comfort of the baby and to provide the pool of bathing water. In other bathing tub configurations the bathing height regulating holes 62 could effectively be in the "floor" forming portions, provided the height is correctly positioned as the floor member is not at the same horizontal position. Broadly speaking the bathing height regulating holes 62 must be above the lowermost bathing portion at a height sufficient to define the desired bath tub depth.

Referring to FIGS. 1, 10, 11, and 11A, the removable occupant support 100 configured so as to be received within the occupant bathing portion 50 downstream of the reservoir 40. For example, the removable occupant support 100 has any suitable shape and size to as to fit within the occupant bathing portion and be supported by the integral contoured floor/occupant back rest 52.

Figure 10:
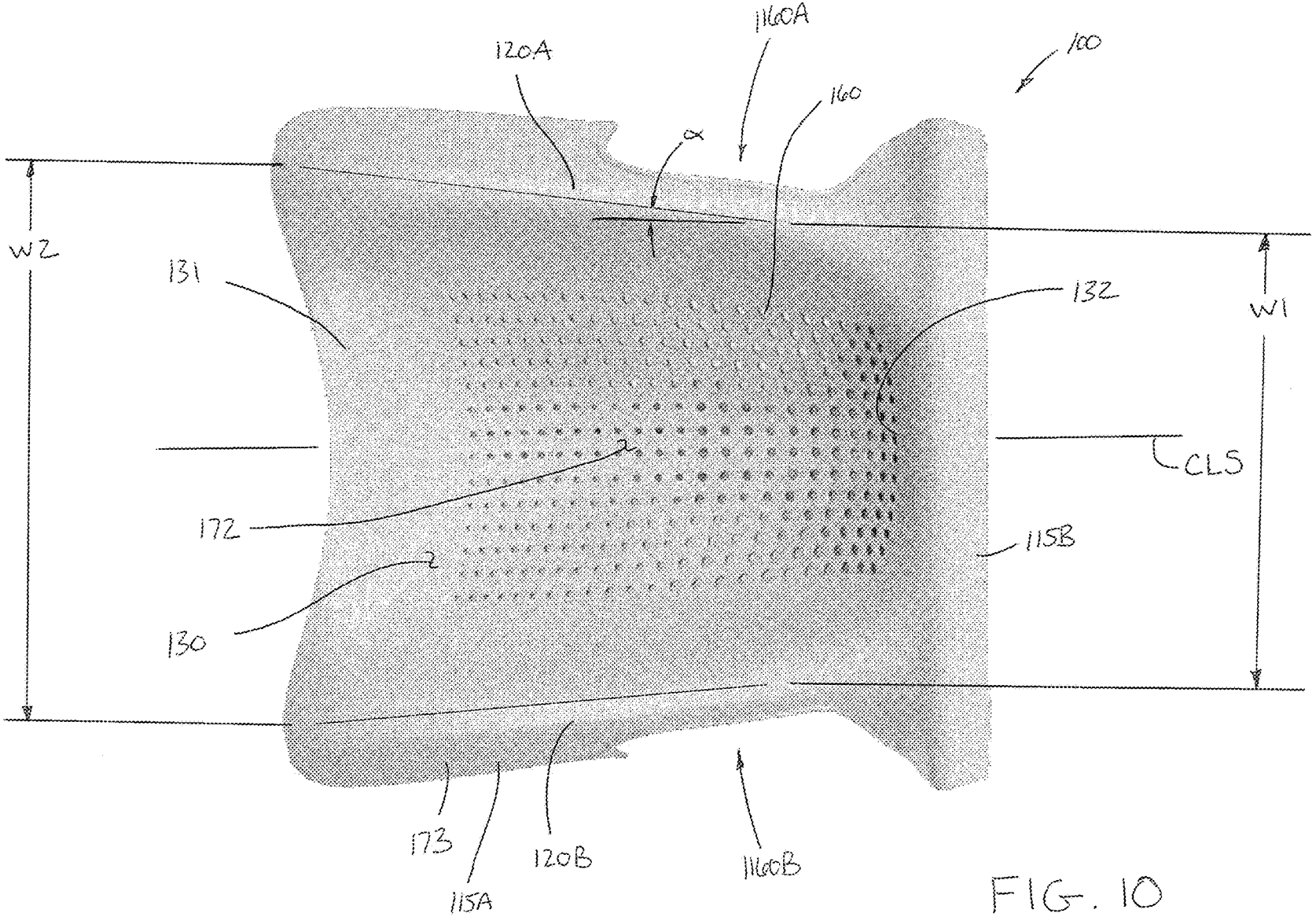
FIG. 10 is a top plan view of an removable insert of the infant and toddler bathing tub of FIG. 1 in accordance with aspects of the present disclosure.
Figures 11, 11A:
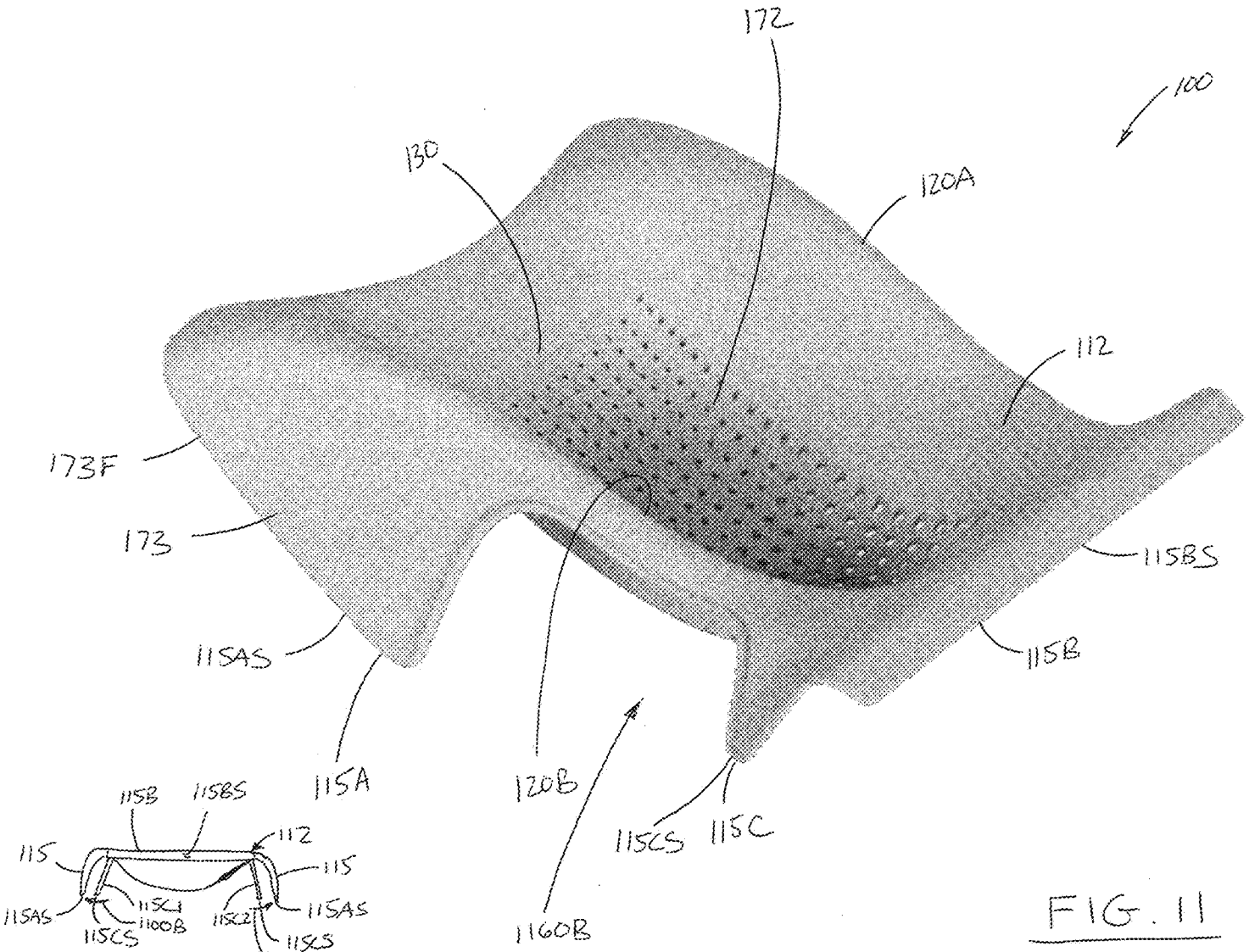
FIG. 11 is a top perspective view of the removable insert of the infant and toddler bathing tub of FIG. 1 in accordance with aspects of the present disclosure.
FIG. 11A is an end view of the of the removable insert of the infant and toddler bathing tub of FIG. 1 in accordance with aspects of the present disclosure.

The removable occupant support 100 includes an insert body or frame 112 that forms or is otherwise connected to a flexible seat 172 and a base projection or wall 173. The insert body 112 is configured so as to be received within the occupant bathing portion 50 of the bathing tub 10 downstream of the reservoir 40 discharging bath water into the occupant bathing portion 50. The flexible seat 172 seats the occupant 1200 (FIG. 12) in the occupant bathing portion 50 and includes a contoured occupant seat/backrest 130 that includes a backrest portion 131 and a seat portion 132. The flexible seat 172 also includes side bolsters 120A, 120B that straddle or otherwise extend along opposite sides of the contoured occupant seat/backrest 130 and seat portion 132 so as to extend in a direction substantially along a centerline CLS of the removable occupant support 100. As can be seen in FIG. 10, the side bolsters 120A, 120B may be angled relative to the centerline CLS so that the contoured occupant seat/backrest 130 is tapered by any suitable angle $\alpha$ towards the seat portion 132 (e.g., a width W1 of the seat portion 132 is narrower than a width W2 of the backrest portion); while in other aspects, the side bolsters 120A, 120B are substantially parallel with the centerline CLS. The side bolsters 120A, 120B extend from the contoured occupant seat/backrest 130 and seat portion 132 to form a recessed area in which the occupant of the bathing tub 10 is held, i.e., with the removable occupant support 100 engaged with the integral contoured floor/occupant back rest 52. The flexible seat 172 includes fluid flow apertures 160 that at least in part provide for the ingress and egress of water to and from at least the seat portion 132 of the flexible seat 172. For example, the fluid flow apertures 160 are configured so that water held within or otherwise flowing through the occupant bathing portion 50 formed by the integral contoured floor/baby occupant backrest 52 enters into or drains from an occupant area of the flexible seat 172 of the removable occupant support 100.

The base projection 173 of the removable occupant support 100 projects from the flexible seat 172 towards the occupant bathing portion 50. In one aspect, the base projection 173 projects down from the flexible seat 172. The base projection 173 is sized and shaped so as to be conformally seated against an interior surface 52S (i.e., that is formed by the integral contoured floor/baby occupant backrest 52) of the occupant bathing portion 50 and supports the flexible seat 172 raised from the interior surface 52S of the occupant bathing portion 50 with the removable occupant support 100 received in the occupant bathing portion 50.

The base projection 173 defines a wall or flange portion 173F surrounding at least a portion of the flexible seat 172. The base projection 173 is contoured so as to engage the integral contoured floor/baby occupant backrest 52 of the tub body 12 and holds at least the seat portion 132 of the contoured occupant seat/backrest 130 spaced from the integral contoured floor/baby occupant backrest 52 by any suitable distance D (see FIG. 6). The distance D provides a space for water flow/circulation in between the contoured occupant seat/backrest 130 and the integral contoured floor/baby occupant backrest 52. The distance D also provides for movement of at least the seat portion 132 of contoured occupant seat/backrest 130 in the direction 600 so that the seat portion 132 moves towards and away from the integral contoured floor/baby occupant backrest 52 as described in greater detail below. The base projection 173 is flexible (as described herein) so as to flexibly release the flexible seat 172 and accommodate flexure of the flexible seat 172 so that the flexible seat 172 conformally fits to and grips an occupant's hips (see FIG. 12) seated therein so as to stably hold the occupant 1200 in a predetermined position within the occupant bathing portion 50 (e.g., such as centered in the occupant bathing portion 50 or in any other suitable position within the occupant bathing portion).

In the aspect, illustrated in FIGS. 1, 10, 11, and 11A (see particularly FIG. 11) the flange portion 173F of the base projection 173 is discontinuous so as to form struts 115A, 115B, 115C1, 155C2 that elevate the flexible seat 172 from the interior surface 52S of the occupant bathing portion 50. The struts 115A, 115B have respective widths that substantially coincide with a width or widths of the integral contoured floor/baby occupant backrest 52 so that the removable occupant support 100 is limited in lateral movement (see direction 199 in FIG. 1) within the occupant bathing portion 50 of the bathing tub 10, and so that the centerline CLS of the removable occupant support 100 is substantially coincident with the centerline CL of the bathing tub 10 (see FIG. 1) (although in other aspects, the centerlines CL, CLS may be offset from one another).

The struts 115C1, 155C2 (one each extending from opposite sides of the flexible seat 172) each include a floor engagement surface 115CS, the strut 115A includes floor engagement surface 115AS, and the strut 115B includes floor engagement surface 115BS. The floor engagement surfaces 115AS, 115BS, 115CS of the struts 115A, 115B, 115C1, 115C2 are discontinuous and have different contact surface areas. For example, the floor engagement surface 115AS of the strut 115A extends along three sides of the insert body 112 (e.g., along an edge of the contoured occupant seat/backrest 130 and along a portion of each of the side bolsters 120A, 120B) so as to form a substantially "U" shaped contact surface. The floor engagement surface 115BS of the strut 115B extends along an edge of the seat portion 132 so as to form a substantially straight linear contact surface. The floor engagement surface 115CS of each of the struts 115C1, 115C2 may be substantially a point contact surface that provides for sliding movement of the respective strut 115C1, 115C2 in direction 1100A, 1100B (see FIG. 11A) by a predetermined amount (as described herein) in reaction to an occupant 1200 (FIG. 12) being placed on the removable occupant support 100.

Movement of the respective strut 115C1, 115C2 in direction 1100A, 1100B is facilitated at least in part by the discontinuous configuration of the base projection 173. In some aspects, the movement of the respective strut 115C1, 115C2 in direction 1100A, 1100B is also facilitated by at least one aperture 1160A, 1160B that extends through the base projection 173. In the aspects illustrated in the figures the apertures 1160A, 1160B are formed between the strut 155A and each of the struts 115C1, 115C2 so that the apertures 1160A, 1160B form the discontinuity between the strut 155A and each of the struts 115C1, 115C2; while in other aspects the apertures 1160A, 1160B are formed through the strut 115A and/or through the strut 115C. In the aspects illustrated in the figures the apertures 1160A, 1160B decrease a size of the base projection 173 (i.e., decrease a distance the base projection 173 extends from the flexible seat 172) adjacent the struts 115C1, 115C2 which at least in part provides for the movement of the respective strut 115C1, 115C2 in direction 1100A, 1100B which, referring also to FIG. 12, causes the side bolsters 120A, 120B to move in directions 1200A, 1200B towards the centerline CLS of the removable occupant support 100 so that the flexible seat 172 conformally fits to and grips the occupant's hips seated therein so as to stably hold the occupant 1200 in a predetermined position within the occupant bathing portion 50. The movement of the struts 150C1, 150C2 in direction 1100A, 1100B and the movement of the movement of the side bolsters 120A, 120B in directions 1200A, 1200B is limited by one or more of properties of the material from which the removable occupant support 100 is constructed and/or any suitable structural stops (i.e., tabs, ribs, etc.) formed into the removable occupant support 100 that physically limit movement of the struts 150C1, 150C2 and/or side bolsters 120A, 120B.

Referring to FIGS. 1-4, 10, and 11, in accordance with aspects of the present disclosure, the at least one aperture 1160A, 1160B extends through the base projection 173 and is disposed so that, with the base projection 173 seated against the interior surface 52S, bath water from under the flexible seat 172 communicates through the base projection 173 with outer sides 52S1, 52S2 of the occupant bathing portion 50. The at least one aperture 1160A, 1160B is downstream of the reservoir weir 42, and at least part of the flexible seat 172 is disposed between the reservoir weir 42 and the at least one aperture 1160A, 1160B in/through the base projection 173. Here, the at least one aperture 1160A, 1160B is a leveling aperture for leveling a bath water level in the occupant bathing portion 50 with the removable occupant support 100 received in the occupant bathing portion 50.

The removable occupant support 100 may be formed in any suitable manner, such as by molding. In one aspect, the removable occupant support 100 is a one piece member having a monolithic construction; while in other aspects the removable occupant support 100 is formed of more than one piece. The removable occupant support 100 is constructed of any suitable elastomer such as any suitable thermoplastic vulcanizate(s) (also referred to as a dynamically vulcanized thermoplastic elastomer(s)) that combine the characteristics of thermoplastics with those of rubbers. For example, thermoplastic vulcanizates are produced by dynamic vulcanization or cross-linking of a rubber during blending and melt-processing with a thermoplastic at elevated temperature. Most thermoplastic vulcanizates are binary blends of polyolefins and thermoplastic diene elastomers. The elastomeric component is one or more of ethylene-propylene-diene, butyl rubber, natural rubber, or nitrile rubber blended with Isotactic polypropylene. The thermoplastic matrix polymer is predominately crystalline isotactic polypropylene. A suitable example of a thermoplastic vulcanizate from which the removable occupant support 100 is constructed is the Santoprene™ thermoplastic vulcanizate available from ExxonMobil Chemical.

Figure 14:
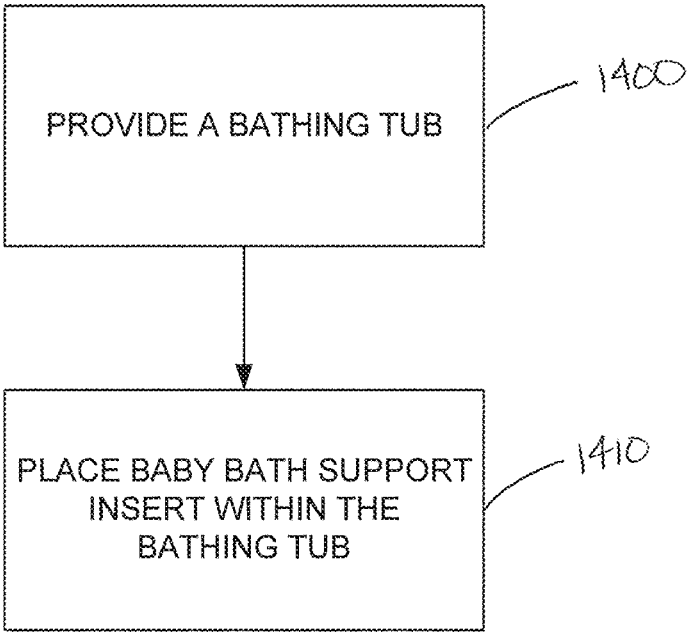
FIG. 14 is an exemplary flow diagram of a method in accordance with aspects of the present disclosure.

Referring now to FIGS. 1-12 and 14, an exemplary method of bathing an occupant will be described. The method includes providing the bathing tub 10 (FIG. 14, Block 1400), having the reservoir 40 and the occupant bathing portion 50 communicably connected to the reservoir 40 by the reservoir weir discharging bath water from the reservoir 40 into the occupant bathing portion 50. The baby bath support insert (otherwise referred to as the removable occupant support) 100 is placed within the bath basin (otherwise referred to as the occupant bathing portion) 50 downstream of the reservoir 40. As noted herein, the base projection 173 of the removable occupant support 100 includes at least one aperture 1160A, 1160B extending through the base projection 173 and disposed so that, with the base projection 173 seated against the interior surface 52S of the occupant bathing portion 50, bath water from under the flexible seat 172 communicates through the base projection 173 with outer sides 52S1, 52S2 of the occupant bathing portion 50. As also described above, a bath water level in the occupant bathing portion 50 is leveled through the at least one aperture 1160A, 1160B with the removable occupant support received in the occupant bathing portion 50. The base projection 173 is flexible so as to flexibly release the flexible seat 172 and accommodate flexure of the flexible seat 172 so that the flexible seat 172 conformally fits to and grips the occupant's hips (see FIG. 12) seated therein so as to stably hold the occupant 1200 in a predetermined position within the occupant bathing portion 50.

In accordance with one or more aspects of the present disclosure a baby bathing system comprises: a bathing tub, having a reservoir and a bath basin communicably connected to the reservoir by a weir discharging bath water from the reservoir into the bath basin; and a baby bath support insert configured so as to be received within the bath basin downstream of the reservoir, the baby bath support insert having a flexible seat, for seating the baby in the bath basin, and a base projection projecting from the flexible seat towards the bath basin, the base projection being sized and shaped so as to be conformally seated against an interior surface of the bath basin and supporting the flexible seat raised from the interior surface of the bath basin with the baby bath support insert received in the bath basin; wherein the base projection includes at least one aperture extending through the base projection and disposed so that, with the base projection seated against the interior surface, bath water from under the flexible seat communicates through the base projection with outer sides of the bath basin.

In accordance with one or more aspects of the present disclosure the baby bath support insert is a one piece member.

In accordance with one or more aspects of the present disclosure the base projection projects down from the flexible seat.

In accordance with one or more aspects of the present disclosure the base projection defines a wall or flange portion surrounding at least a portion of the flexible seat.

In accordance with one or more aspects of the present disclosure the base projection comprises struts elevating the flexible seat from the interior surface of the bath basin.

In accordance with one or more aspects of the present disclosure the at least one aperture is downstream of the weir, and at least part of the flexible seat is disposed between the weir and the at least one aperture in the base projection.

In accordance with one or more aspects of the present disclosure the at least one aperture is a leveling aperture for leveling a bath water level in the bath basin with the baby bath support insert received in the bath basin.

In accordance with one or more aspects of the present disclosure the base projection is flexible so as to flexibly release the flexible seat and accommodate flexure of the flexible seat so that the flexible seat conformally fits to and grips a baby's hips seated therein so as to stably hold the baby in a predetermined position within the bath basin.

In accordance with one or more aspects of the present disclosure a baby bathing system comprises: a bathing tub, having a reservoir and a bath basin communicably connected to the reservoir by a weir discharging bath water from the reservoir into the bath basin; and a baby bath support insert configured so as to be received within the bath basin downstream of the reservoir, the baby bath support insert having a flexible seat, for seating the baby in the bath basin, and a base wall projecting from the flexible seat towards the bath basin, the base wall being sized and shaped so as to be conformally seated against an interior surface of the bath basin and supporting the flexible seat raised from the interior surface of the bath basin with the insert received in the bath basin; wherein the base wall surrounds at least part of the flexible seat and is flexible so as to flexibly release the flexible seat and accommodate flexure of the flexible seat so that the flexible seat conformally fits to and grips a baby's hips seated therein so as to stably hold the baby in a predetermined position within the bath basin.

In accordance with one or more aspects of the present disclosure the base wall includes at least one leveling aperture extending through the base wall and disposed so that, with the base wall seated against the interior surface, bath water from under the flexible seat communicates via the at least one leveling aperture through the base wall with outer sides of the bath basin.

In accordance with one or more aspects of the present disclosure the at least one leveling aperture is downstream of the weir, and at least part of the flexible seat is disposed between the weir and the at least one leveling aperture in the base wall.

In accordance with one or more aspects of the present disclosure the at least one leveling aperture levels a bath water level in the bath basin with the baby bath support insert received in the bath basin.

In accordance with one or more aspects of the present disclosure the baby bath support insert is a one piece member.

In accordance with one or more aspects of the present disclosure the base wall projects down from the flexible seat.

In accordance with one or more aspects of the present disclosure the base wall comprises struts elevating the flexible seat from the interior surface of the bath basin.

In accordance with one or more aspects of the present disclosure baby bath support insert comprises: a frame configured so as to be received within a bath basin of a bathing tub downstream of a reservoir discharging bath water into the bath basin, a flexible seat connected to the frame, for seating the baby in the bath basin; and a base wall connected to the frame and projecting from the flexible seat towards the bath basin, the base wall being sized and shaped so as to be conformally seated against an interior surface of the bath basin and supporting the flexible seat raised from the interior surface of the bath basin with the insert received in the bath basin; wherein the base wall surrounds at least part of the flexible seat and is flexible so as to flexibly release the flexible seat and accommodate flexure of the flexible seat so that the flexible seat conformally fits to and grips a baby's hips seated therein so as to stably hold the baby in a predetermined position within the bath basin.

In accordance with one or more aspects of the present disclosure the base wall includes at least one leveling aperture extending through the base wall and disposed so that, with the base wall seated against the interior surface, bath water from under the flexible seat communicates via the at least one leveling aperture through the base wall with outer sides of the bath basin.

In accordance with one or more aspects of the present disclosure the at least one leveling aperture is downstream of a weir that communicably connects the reservoir to the bath basin, and at least part of the flexible seat is disposed between the weir and the at least one leveling aperture in the base wall.

In accordance with one or more aspects of the present disclosure the at least one leveling aperture levels a bath water level in the bath basin with the baby bath support insert received in the bath basin.

In accordance with one or more aspects of the present disclosure the baby bath support insert is a one piece member.

In accordance with one or more aspects of the present disclosure the base wall projects down from the flexible seat.

In accordance with one or more aspects of the present disclosure the base wall comprises struts elevating the flexible seat from the interior surface of the bath basin.

In accordance with one or more aspects of the present disclosure a method for bathing a baby is provided. The method comprises: providing a bathing tub, having a reservoir and a bath basin communicably connected to the reservoir by a weir discharging bath water from the reservoir into the bath basin; and placing a baby bath support insert within the bath basin downstream of the reservoir, the baby bath support insert having a flexible seat, for seating the baby in the bath basin, and a base projection projecting from the seat towards the bath basin, the base projection being sized and shaped so as to be conformally seated against an interior surface of the bath basin and supporting the flexible seat raised from the interior surface of the bath basin with the insert received in the bath basin; wherein the base projection includes at least one aperture extending through the base projection and disposed so that, with the base projection seated against the interior surface, bath water from under the flexible seat communicates through the base projection with outer sides of the bath basin.

In accordance with one or more aspects of the present disclosure the baby bath support insert is a one piece member.

In accordance with one or more aspects of the present disclosure the base projection projects down from the flexible seat.

In accordance with one or more aspects of the present disclosure the base projection defines a wall or flange portion surrounding at least a portion of the flexible seat.

In accordance with one or more aspects of the present disclosure the base projection comprises struts elevating the flexible seat from the interior surface of the bath basin.

In accordance with one or more aspects of the present disclosure the at least one aperture is downstream of the weir, and at least part of the flexible seat is disposed between the weir and the at least one aperture in the base projection.

In accordance with one or more aspects of the present disclosure the method further comprises leveling a bath water level in the bath basin through the at least one aperture with the baby bath support insert received in the bath basin.

In accordance with one or more aspects of the present disclosure the base projection is flexible so as to flexibly release the flexible seat and accommodate flexure of the flexible seat so that the flexible seat conformally fits to and grips a baby's hips seated therein so as to stably hold the baby in a predetermined position within the bath basin.

It should be understood that the foregoing description is only illustrative of the aspects of the present disclosure. Various alternatives and modifications can be devised by those skilled in the art without departing from the aspects of the present disclosure. Accordingly, the aspects of the present disclosure are intended to embrace all such alternatives, modifications and variances that fall within the scope of any claims appended hereto. Further, the mere fact that different features are recited in mutually different dependent or independent claims does not indicate that a combination of these features cannot be advantageously used, such a combination remaining within the scope of the aspects of the present disclosure.

What is claimed is:

1. A baby bathing system comprising:

a bathing tub, having a reservoir and a bath basin communicably connected to the reservoir by a weir discharging bath water from the reservoir into the bath basin; and a baby bath support insert configured so as to be received within the bath basin downstream of the reservoir, the baby bath support insert having a flexible seat, for seating the baby in the bath basin, and a base projection projecting from the flexible seat towards the bath basin, the base projection being sized and shaped so as to be conformally seated against an interior surface of the bath basin and supporting the flexible seat raised from the interior surface of the bath basin with the baby bath support insert received in the bath basin;

wherein the base projection includes at least one aperture extending through the base projection and disposed so that, with the base projection seated against the interior surface, bath water from under the flexible seat communicates through the base projection with outer sides of the bath basin.

2. The baby bathing system of claim 1, wherein the baby bath support insert is a one piece member.

3. The baby bathing system of claim 1, wherein the base projection projects down from the flexible seat.

4. The baby bathing system of claim 1, wherein the base projection defines a wall or flange portion surrounding at least a portion of the flexible seat.

5. The baby bathing system of claim 1, wherein the base projection comprises struts elevating the flexible seat from the interior surface of the bath basin.

6. The baby bathing system of claim 1, wherein the at least one aperture is downstream of the weir, and at least part of the flexible seat is disposed between the weir and the at least one aperture in the base projection.

7. The baby bathing system of claim 1, wherein the at least one aperture is a leveling aperture for leveling a bath water level in the bath basin with the baby bath support insert received in the bath basin.

8. The baby bathing system of claim 1, wherein the base projection is flexible so as to flexibly release the flexible seat and accommodate flexure of the flexible seat so that the flexible seat conformally fits to and grips a baby's hips seated therein so as to stably hold the baby in a predetermined position within the bath basin.

9. A baby bathing system comprising:

a bathing tub, having a reservoir and a bath basin communicably connected to the reservoir by a weir discharging bath water from the reservoir into the bath basin; and a baby bath support insert configured so as to be received within the bath basin downstream of the reservoir, the baby bath support insert having a flexible seat, for seating the baby in the bath basin, and a base wall projecting from the flexible seat towards the bath basin, the base wall being sized and shaped so as to be conformally seated against an interior surface of the bath basin and supporting the flexible seat raised from the interior surface of the bath basin with the insert received in the bath basin;

wherein the base wall surrounds at least part of the flexible seat and is flexible so as to flexibly release the flexible seat and accommodate flexure of the flexible seat so that the flexible seat conformally fits to and grips a baby's hips seated therein so as to stably hold the baby in a predetermined position within the bath basin.

10. The baby bathing system of claim 9, wherein the base wall includes at least one leveling aperture extending through the base wall and disposed so that, with the base wall seated against the interior surface, bath water from under the flexible seat communicates via the at least one leveling aperture through the base wall with outer sides of the bath basin.

11. The baby bathing system of claim 10, wherein the at least one leveling aperture is downstream of the weir, and at least part of the flexible seat is disposed between the weir and the at least one leveling aperture in the base wall.

12. The baby bathing system of claim 10, wherein the at least one leveling aperture levels a bath water level in the bath basin with the baby bath support insert received in the bath basin.

13. The baby bathing system of claim 9, wherein the baby bath support insert is a one piece member.

14. The baby bathing system of claim 9, wherein the base wall projects down from the flexible seat.

15. The baby bathing system of claim 9, wherein the base wall comprises struts elevating the flexible seat from the interior surface of the bath basin.

16. A baby bath support insert comprising:

a frame configured so as to be received within a bath basin of a bathing tub downstream of a reservoir discharging bath water into the bath basin, a flexible seat connected to the frame, for seating the baby in the bath basin; and a base wall connected to the frame and projecting from the flexible seat towards the bath basin, the base wall being sized and shaped so as to be conformally seated against an interior surface of the bath basin and supporting the flexible seat raised from the interior surface of the bath basin with the insert received in the bath basin;

wherein the base wall surrounds at least part of the flexible seat and is flexible so as to flexibly release the flexible seat and accommodate flexure of the flexible seat so that the flexible seat conformally fits to and grips a baby's hips seated therein so as to stably hold the baby in a predetermined position within the bath basin.

17. The baby bath support insert of claim 16, wherein the base wall includes at least one leveling aperture extending through the base wall and disposed so that, with the base wall seated against the interior surface, bath water from under the flexible seat communicates via the at least one leveling aperture through the base wall with outer sides of the bath basin.

18. The baby bath support insert of claim 17, wherein the at least one leveling aperture is downstream of a weir that communicably connects the reservoir to the bath basin, and at least part of the flexible seat is disposed between the weir and the at least one leveling aperture in the base wall.

19. The baby bath support insert of claim 17, wherein the at least one leveling aperture levels a bath water level in the bath basin with the baby bath support insert received in the bath basin.

20. The baby bath support insert of claim 16, wherein the baby bath support insert is a one piece member.

21. The baby bath support insert of claim 16, wherein the base wall projects down from the flexible seat.

22. The baby bath support insert of claim 16, wherein the base wall comprises struts elevating the flexible seat from the interior surface of the bath basin.

23. A method for bathing a baby, the method comprising:

providing a bathing tub, having a reservoir and a bath basin communicably connected to the reservoir by a weir discharging bath water from the reservoir into the bath basin; and placing a baby bath support insert within the bath basin downstream of the reservoir, the baby bath support insert having a flexible seat, for seating the baby in the bath basin, and a base projection projecting from the seat towards the bath basin, the base projection being sized and shaped so as to be conformally seated against an interior surface of the bath basin and supporting the flexible seat raised from the interior surface of the bath basin with the insert received in the bath basin;

wherein the base projection includes at least one aperture extending through the base projection and disposed so that, with the base projection seated against the interior surface, bath water from under the flexible seat communicates through the base projection with outer sides of the bath basin.

24. The method of claim 23, wherein the baby bath support insert is a one piece member.

25. The method of claim 23, wherein the base projection projects down from the flexible seat.

26. The method of claim 23, wherein the base projection defines a wall or flange portion surrounding at least a portion of the flexible seat.

27. The method of claim 23, wherein the base projection comprises struts elevating the flexible seat from the interior surface of the bath basin.

28. The method of claim 23, wherein the at least one aperture is downstream of the weir, and at least part of the flexible seat is disposed between the weir and the at least one aperture in the base projection.

29. The method of claim 23, further comprising leveling a bath water level in the bath basin through the at least one aperture with the baby bath support insert received in the bath basin.

30. The method of claim 23, wherein the base projection is flexible so as to flexibly release the flexible seat and accommodate flexure of the flexible seat so that the flexible seat conformally fits to and grips a baby's hips seated therein so as to stably hold the baby in a predetermined position within the bath basin.

* * * * *